US007911121B2

(12) United States Patent
Bunk et al.

(10) Patent No.: US 7,911,121 B2
(45) Date of Patent: Mar. 22, 2011

(54) INCANDESCENT LAMP HAVING AN ILLUMINANT THAT CONTAINS A HIGH-TEMPERATURE RESISTANT METAL COMPOUND

(75) Inventors: Axel Bunk, Munich (DE); Matthias Damm, Gaimersheim (DE); Georg Rosenbauer, Wassertrüdingen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 894 days.

(21) Appl. No.: 11/665,158

(22) PCT Filed: Oct. 18, 2005

(86) PCT No.: PCT/DE2005/001857

§ 371 (c)(1),
(2), (4) Date: Apr. 12, 2007

(87) PCT Pub. No.: WO2006/045273

PCT Pub. Date: May 4, 2006

(65) Prior Publication Data

US 2009/0045742 A1 Feb. 19, 2009

(51) Int. Cl.
*H01J 19/42* (2006.01)

(52) U.S. Cl. ..... 313/271

(58) Field of Classification Search ..... 313/271, 313/627–628

See application file for complete search history.

(56) References Cited

U.S. PATENT DOCUMENTS

| | | | |
|---|---|---|---|
| 3,237,284 | A | 3/1966 | Bird |
| 3,277,330 | A | 10/1966 | Cooper, Jr. |
| 3,311,777 | A | 3/1967 | Schroder |
| 3,405,328 | A | 10/1968 | Johansen et al. |
| 3,717,784 | A | 2/1973 | Matheson |
| 4,450,381 | A | 5/1984 | Kendrick et al. |
| 2005/0023985 | A1 | 2/2005 | Arnold |
| 2006/0103305 | A1 | 5/2006 | Bunk et al. |

FOREIGN PATENT DOCUMENTS

| | | |
|---|---|---|
| DE | 103 56 651 | 6/2005 |
| GB | 08283 | 8/1909 |
| WO | WO 01/15206 | 3/2001 |
| WO | WO 03/075315 | 9/2003 |
| WO | WO 2005/055274 | 6/2005 |

OTHER PUBLICATIONS

English Translation of DE 103 56 651 A1.*

* cited by examiner

*Primary Examiner* — Toan Ton
*Assistant Examiner* — Hana S Featherly

(57) ABSTRACT

The invention relates to an incandescent lamp (1) which is provided with an illuminant (7) which is inserted in a bulb (2) together with a filling in a vacuum-tight manner, the illuminant (7) comprising a metal carbide that has a melting point above that of tungsten. The bulb also comprises a source and a sink for a material of which the illuminant is depleted during use.

10 Claims, 5 Drawing Sheets

INCANDESCENT LAMP HAVING AN ILLUMINANT THAT CONTAINS A HIGH-TEMPERATURE RESISTANT METAL COMPOUND

TECHNICAL FIELD

The invention is based on an incandescent lamp having an illuminant, which contains a high-temperature resistant metal compound, according to the preamble of claim 1. These are in particular incandescent lamps with a carbide-containing illuminant, and in particular the invention relates to incandescent halogen lamps which comprise a TaC illuminant or whose illuminant contains TaC as a constituent or coating.

PRIOR ART

An incandescent lamp having an illuminant, which contains a high-temperature resistant metal compound, is known from many documents. An as yet unresolved problem is the greatly restricted lifetime. One possibility, presented in WO-A 01/15266, consists in connecting the illuminant to a separate framework for support.

One widespread way of achieving the object of preventing evaporation of material from the illuminant consists in using cycle processes. In this case, the filling gas is supplemented with a further chemical substance which reacts in cooler regions with the evaporated material to form a relatively volatile compound, which is not deposited on the bulb wall. This compound is transported in the direction of the illuminant by the concentration gradient set up—i.e. high concentration near the bulb wall, low concentration near the illuminant. At the high temperatures close to the illuminant, it decomposes by breaking down into the material of the illuminant and the added chemical substance; the material of the illuminant is deposited thereon again.

EXAMPLES

(a) Tungsten-Halogen Cycle Process

The tungsten evaporated from the illuminant reacts at lower temperatures near the bulb wall to form tungsten halides, which are volatile at temperatures above approximately 200° C. and are not deposited on the bulb wall. This prevents loss of tungsten on the bulb wall. The tungsten halide compounds are transported by diffusion and possibly convection back to the hot illuminant, where they decompose. The tungsten thereby released is deposited again on the illuminant. However, the tungsten is not in general transported back to the same position from which it evaporated, rather is deposited on a position at a different temperature i.e. the cycle process is not regenerative. One exception is the fluorine cycle process.

(b) Carbon-Hydrogen Process in TaC Lamps

The gaseous carbon given off by the decomposition of TaC is transported in the direction of the bulb wall, where it reacts with hydrogen to form hydrocarbons such as methane. The hydrocarbons are transported back to the hot illuminant, where they re-decompose. The carbon is thereby released again and can be deposited on the illuminant. However, the hydrocarbons decompose at low temperatures even below 1000 K, so that the carbon is not returned expediently to the hottest position of the illuminant.

If the evaporation from the illuminant is relatively strong in the example described last, and the compound supporting the cycle process is stable only at very low temperatures like the hydrocarbons in the last example, then rapid destruction of the illuminant takes place because it is depleted very rapidly of the evaporating material, such as carbon in the last example. Overall, the carbon is transported relatively quickly from the hottest position of the illuminant to the cooler positions of the illuminant, or the connections to the illuminant, which may likewise present problems for example due to inter-turn faults. Only a very small proportion of the carbon transported back still reaches the hottest position of the element (very low regeneration factor). Furthermore, the reverse reaction of carbon with hydrogen to form hydrocarbons in any event takes place quickly enough, so that blackening of the bulb is avoided, only with a relatively large hydrogen excess.

In summary, in such cases as in the TaC lamp, the use of a cycle process in which:

(a) the material is first evaporated or transported away from the illuminant relatively quickly, and (b) secondly the evaporated material forms a chemical compound only at very low temperatures, is insufficient for many applications because, owing to the only very low return of material to the positions away from which it was transported, the illuminant is destroyed very rapidly.

As a way of resolving this problem, WO-A 03/075315 describes regeneration of the illuminant from a depot. A chemical substance, which resupplies the illuminant with that substance of which it is depleted, is evaporated progressively from the depot. For example, as described, a TaC illuminant is regenerated from a polymer impregnated with an organic compound (for example acetone). A chemical compound, which also contains inter alia carbon, is supplied permanently to the gas phase; carbon is progressively made available, which can replace the carbon evaporated from the illuminant. A disadvantage is that the compositions of the gas phase as well as of the illuminant change progressively owing to the permanently supplied chemical compound; lamp operation under stable conditions is thus scarcely possible. The concentration of carbon in the gas phase is constantly increased, which in the end leads to deposition of carbon at unsuitable positions such as the ends of the illuminant or finally even on the bulb wall. Enrichment of the illuminant with carbon is also undesirable because the properties of the illuminant then change progressively. Enrichment of the gas phase with hydrogen leads to greater cooling of the illuminant by increasing the thermal conduction.

In summary, stable operation of a lamp is not possible with a chemical compound being evaporated progressively from a depot, because the compositions of the gas phase and possibly also of the illuminant itself change continuously.

As another option, WO Patent 03/075315 describes the mutual regeneration of two alternately operated illuminants. In this case, carbon evaporates permanently from an "active" illuminated operated at high temperatures (above 3000 K) and is transported to an "inactive" second illuminant operated at relatively low temperatures (around or below 2000 K), where it is deposited or accumulates. Once the "active" illuminant is depleted of carbon, they are switched over; the previously "inactive" illuminant is operated at high temperature and the previously "active" illuminant is kept at low temperature. The now "inactive" illuminant is regenerated by the "active" illuminant evaporating carbon. A disadvantage in this case is that two illuminants are required, between which it is necessary to switch over constantly.

SUMMARY OF THE INVENTION

It is an object of the present invention to provide an incandescent lamp having an illuminant which contains a high-temperature resistant metal compound, and in particular a carbide-containing illuminant, or alternatively a metal, according to the preamble of claim 1, which permits a long lifetime and overcomes the problem of the illuminant being depleted of an evaporating component.

These objects are achieved by the characterizing features of claim 1. Particularly advantageous configurations can be found in the dependent claims.

The term high-temperature resistant metal compound means compounds whose melting point lies close to the melting point of tungsten, sometimes even above. The material of the illuminant is preferably TaC or $Ta_2C$. Carbides of Hf, Nb or Zr are nevertheless suitable as well, as are alloys of these carbides. Also nitrides or borides of such metals. A property which these compounds have in common is that an illuminant made of this material becomes depleted of at least one element during operation. The principle described below is moreover equally applicable to illuminants made of metals. The term metal compound as used below is therefore not to be understood restrictively, but by way of example. The comments made are similarly applicable to metals.

If an illuminant is operated at high temperatures, then—depending on the constitution of the material of the illuminant—evaporation of material or constituents of the material takes place. The evaporated material or its constituents are transported away for example by convection, diffusion or thermodiffusion, and are deposited at another position in the lamp, for example on the bulb wall or framework parts. The evaporation of the material or its constituents leads to rapid destruction of the illuminant. The transmission of the light is greatly reduced by material depositing on the bulb wall.

EXAMPLES (a) The tungsten evaporated from an incandescent filament made of tungsten in a conventional incandescent lamp is transported to the bulb wall, and is deposited there.

(b) A tantalum carbide illuminant operated at high temperatures decomposes to form the brittle subcarbide $Ta_2C$ that melts at lower temperatures than TaC, and gaseous carbon which is transported to the bulb wall and is deposited there.

The object is to minimize or reverse evaporation from the illuminant by suitable measures.

In order to prevent the illuminant from being depleted of the evaporated component, a concentration of the evaporating component is set up such that in the ideal case evaporation and sublimation maintain equilibrium, and the illuminant is thus neither depleted of nor enriched with the component in question. The required concentration is intended to be set up over the illuminant by continuous transport of a substance containing the component in question from a source into a sink. The progressive deposition of the substance replenished from the source avoids changing the composition of the gas phase, and allows operation of the illuminant under constant conditions.

In one possible layout of a lamp with a TaC illuminant, the source consists of a solid or liquid hydrocarbon, which is introduced into the lamp so that a particular vapor pressure of gaseous hydrocarbon is built up over the source material. This hydrocarbon is transported by diffusion or convection into the interior of the lamp, where it decomposes at high temperatures close to the illuminant. The illuminant thus lies in a carbon-enriched atmosphere; destruction of the illuminant is thereby prevented. In the ideal case, the illuminant neither gives off carbon to the surroundings nor is enriched with carbon. In other words, an equilibrium between carbon deposition and carbon evaporation is set up at the illuminant. At lower temperatures close to the bulb wall, the carbon reacts again with hydrogen to reform hydrocarbons. On a wire applied at a suitable temperature, for example one made of the materials iron, nickel, cobalt, platinum or molybdenum with a sufficiently large surface area, the hydrocarbon decomposes while depositing solid carbon (carbon black). This process corresponds substantially to the cracking of hydrocarbons on suitable catalysts which is known from industrial chemistry, although in this case—in contrast to the reaction management in chemical industry plants—the deposition of carbon on the catalyst is desired. Overall, therefore, carbon progressively emerges from a source and is re-deposited in a sink. The illuminant of the lamp is therefore neither enriched with carbon nor depleted of carbon; furthermore, the carbon concentration in the gas phase is kept constant.

A similar procedure may preferably be adopted with hydrogen. The permeable quartz bulb wall at high temperatures acts as a hydrogen sink. At lower temperatures, the hydrogen given off can be captured by iodine (reaction to form hydrogen iodide); the hydrogen iodide thereby formed is noncritical in respect of its impact on the maintenance of the lamp, because it neither affects the chemistry of the metal carbide nor changes the physical properties of the filling gas (in particular the thermal conductivity). Another possibility for binding the released hydrogen (i.e. a sink for hydrogen) consists in using metals such as zirconium or hafnium or niobium or tantalum, which "getter" hydrogen at suitable temperatures.

It should once more be pointed out that the existence of a sink is important for the functionality of the lamp. In the absence of sinks for carbon and hydrogen, either the gas phase or the illuminant would become enriched with the respective element; the consequence of this would be to alter the operating data of the lamp. In particular, one or more cycle processes may be superimposed on the transport processes described in the last paragraphs. If, for example in a lamp having an illuminant made of TaC, hydrogen—sometimes in the form of hydrocarbons—is transported from a source to a sink, then a tantalum-halogen cycle process, by which the tantalum evaporated from the illuminant is prevented from depositing on the bulb wall and is at least partially transported back to the illuminant, may be superimposed on this transport process by adding a halogen compound as described for example in the as yet unpublished application DE-No. 103 56 651.1. Explicit reference is made thereto. For a TaC lamp, it is furthermore conceivable to superimpose a carbon cycle process on the described permanent transport of carbon from a source into a sink, for example a C—H, C-halogen, C—S or C—N cycle process as described in application DE-No. 103 56 651.1.

The metals used as sinks may be welded onto the framework or the electrode for example in the form of wires or platelets, or wound directly around the electrode as an overcoat coil, or pinch-sealed directly, for example in the form of wires. What is essential, particularly when using catalytically active metals as sinks, is that the surface area of these metals is sufficient in order to maintain effectiveness of the catalyst, since the surface will in fact become covered progressively with carbon ("poisoning" of the catalyst). Likewise, the coating of filament connections or electrodes with metals serving as a sink is another embodiment.

In another embodiment, elementary carbon is used as a source for carbon. This may for example be provided in the form of carbon moldings, graphite fibers or carbon black deposited on a substrate, diamond in the form of DLC or graphite. The carbon is kept at a "medium" temperature which must be accurate enough so that the resulting vapor pressure of the carbon at the position of the hot illuminant leads to a carbon partial pressure that corresponds approximately to the equilibrium carbon vapor pressure over the tantalum carbide. Carbon deposition and carbon evaporation therefore remain in equilibrium at the illuminant; decarburization of the illuminant is thus avoided. If the carbon reaches cooler regions near the bulb wall, then it reacts with hydrogen or halogens to form (possibly halogenated) hydrocarbons; deposition of the carbon on the bulb wall is thereby prevented. The decomposition of the hydrocarbon then takes place on a catalyst, in which case the carbon deposits on the surface of the catalyst and the hydrogen is released again. No sink is needed in this case for the hydrogen or possibly the halogen, which in fact only prevent deposition of the carbon on the bulb wall and transport the carbon bound in the form of hydrocarbon to the catalyst. The hydrogen or optionally the halogen serves here merely as a transport medium in order to transport the carbon, and is not consumed. Overall, in this case carbon is transported from the carbon source (carbon molding, graphite fibers, diamond such as DLC, graphite layers, carbon black, etc.) to the carbon sink (for example wire made of nickel, iron, molybdenum), where it is deposited again.

In one embodiment of the carbon source, the carbon is deposited on a few turns of the metal carbide illuminant configured as a filament. The carbon is preferably deposited on the outer turns of the filament at lower temperatures than in the middle of the illuminant. Since the vapor pressure over pure carbon is greater than the carbon vapor pressure over tantalum carbide, the source comprising pure carbon is applied at lower temperatures than in the hot filament middle. This is as far as possible intended to set up the equilibrium carbon vapor pressure over the middle of the hot filament, and make sure that no carbon partial pressure gradient driving the carbon transport is formed over the illuminant.

The procedure described last is also useful for circumventing problems in respect of the relatively low impact strength of tantalum carbide when transporting the lamps to the customer. One option for circumventing this problem is to delay completion of the carburization by burning in until after transporting the lamps to the customer, and initially to leave at least a tantalum core remaining in the TaC illuminant. In order to complete the carburization at the customer's end, large amounts of carbon must be supplied to the still incompletely carburized illuminant when burning the lamp in. If these large amounts of carbon are stored in the form of gaseous hydrocarbons in the gas atmosphere or in the form of continuously evaporating solid hydrocarbons, then very large amounts of hydrogen will be released during the carburizing reaction, which then detrimentally affect the efficiency of the lamp owing to the increase in the thermal conductivity. Since the reaction with the hydrocarbon does not actually take place completely, the large amounts of released carbon that must be held in the gas phase likewise constitute a problem. This problem can be circumvented in the described way by placing the still incompletely carburized illuminant in a continuous flow of a carbon stream emerging from a carbon source. The carbon not utilized for the carburization reacts with hydrogen to form hydrocarbons, so that deposition of the carbon on the bulb wall is prevented. The hydrocarbon finally decomposes again on a catalyst, the unneeded carbon being deposited and hydrogen being released. This makes do with a relatively small amount of hydrogen because it is not consumed, rather it is used only for transporting the carbon to the carbon sink. In particular, the amount of hydrogen remains constant and does not increase permanently during the carburization. If the permeability of the hydrogen is no longer negligible in the event of a high bulb temperature, particularly in the case of a bulb made of quartz glass, then the hydrogen may be recaptured near the bulb wall as hydrogen iodide and stabilized by using iodine.

Another possible way of producing a carbon source consists in using a carbon fiber coated with tantalum carbide. At the high operating temperatures, the carbon diffuses through the tantalum carbide layer; this prevents the tantalum carbide layer from being depleted of carbon. If no countermeasures are taken, however, the carbon thereby released into the gas space leads to rapid blackening of the bulb wall. By capturing the carbon by hydrogen with a bulb temperature which is not too high, blackening of the bulb can be prevented. However, very large amounts of hydrogen are needed in order to "capture" the carbon as fully as possible before it is deposited on the bulb wall. This can be avoided by decomposing the hydrocarbon on a catalyst kept at a suitable temperature, for example a wire of nickel, iron, etc. The carbon then deposits on the nickel wire, while the hydrogen is released again and is available for reaction with further carbon. The hydrogen thus serves merely as a "vehicle", in order to capture carbon transported away from the illuminant by forming hydrocarbon and transport it to the carbon sink (for example wire made of nickel, molybdenum, . . . ). Overall no hydrogen is consumed by this transport mechanism, i.e. it makes do with a relatively small amount of hydrogen. If a cycle process were to be implemented as an alternative, then very large amounts of hydrogen would need to be used in order to capture the carbon transported away in a large concentration from the illuminant by forming hydrocarbons, or to build up such a high concentration of hydrocarbons near the bulb wall that the transport of carbon back to the illuminant exactly balances the transport away. The use of such large amounts of hydrogen would greatly impair the efficiency of the lamp.

Another possible way of providing a source is offered by coating the illuminant with the material, of which it is depleted and which is intended to be resupplied from a source, and then once again to apply a layer of the illuminant material per se from the outside onto this layer. If an illuminant consists of a metal carbide such as tantalum carbide or hafnium carbide, for example, then a layer of carbon will be deposited on the surface of the illuminant made of metal carbide. A layer of a metal carbide will then in turn be deposited on this layer of carbon. If carbon evaporates from the outer metal carbide layer during lamp operation, then carbon from the inside immediately diffuses out from the enclosed carbon layer and prevents the outer metal carbide layer from being depleted of carbon. In this regard, the functionality is quite similar to that of a carbon fiber coated with metal carbide. An advantage with this procedure, however, is that process technology established in halogen lamp construction can essentially be employed for producing the illuminant. The carbon coating is applied for example according to a CVD method in the rod lamp, for example by decomposition of methane (1 bar pressure) at a temperature of approximately 2500 K on the illuminant. The outer layer consisting of metal carbide is applied by the CVD method, for example by simultaneous thermal decomposition of metal halides such as tantalum halide and methane; it is naturally also possible to use other metal compounds or hydrocarbons as precursors. By setting up suitable stoichiometric ratios of the starting compounds, the metal carbide can then be deposited directly on the surface of the illuminant, for example according to $TaCl_5+CH_4+xH_2 \rightarrow TaC+5HCl+(x-\frac{1}{2})H_2$. The hydrogen is used here to avoid depositing carbon black. It is also possible to deposit just the metal on the illuminant's surface consisting of carbon, and only then to react (for example carburize) it in an atmosphere containing for example methane, in which case the carburizing sets in from the outer atmosphere containing carbon and on the inside from the carbon layer. A disadvantage with this method, however, is that the volume change occurring during conversion of the metal carbide causes relatively large layer stresses. Simultaneous deposition of the metal and carbon in the stoichiometric ratio is therefore advantageous.

In the exemplary embodiment mentioned last, the materials of the metal carbide inner material (for example wire) and of the metal carbide outer layer need not necessarily be identical. For example, the inner wire may consist of tantalum carbide while the outer layer, applied on the carbon layer, consists of hafnium carbide or the alloy HfC-4TaC. Over HfC or the alloy HfC-4TaC, lower vapor pressures prevail than for instance over pure tantalum carbide. Yet, since hafnium is much more expensive than tantalum, the amount of hafnium used can be reduced significantly in this way.

Sintered materials comprising carbon may also be envisaged as another source for carbon, as described for example in U.S. Pat. No. 3,405,328. This describes the way in which metal carbides, for example tantalum carbide with dissolved carbon, can be produced by sintering processes at high temperatures and high pressures in autoclaves. These materials, which are intended to be used as an illuminant material, then naturally contain more carbon than is to be expected according to the stoichiometry of TaC. The patent also describes using mixtures of different carbides, in order to increase the impact strength of the illuminant.

Further options which may be envisaged for carbon sinks are metals, for example tungsten, tantalum, zirconium etc., which form carbides at suitable temperatures. The operating temperature of these metals is dictated in particular by the carbon flux coming from the illuminant; temperatures in the range between 1800° C. and 2500° C. are customary. When employing these metals, hydrogen is preferably used in order to prevent the carbon from depositing on the bulb wall and transport it to the carbon sink. If the hydrogen were to be omitted, then the carbon transported away from the illuminant—unless it encounters the carbide-forming metal by chance on its way from the illuminant—would deposit on the bulb wall. With the additional use of hydrogen, the carbon firstly reacts with the hydrogen to form a hydrocarbon such as methane, which is then re-decomposed on the carbide-forming metal by transferring the carbon onto the carbon-forming metal and releasing the hydrogen.

Other possible catalysts for the decomposition of hydrocarbons are aluminum, molybdenum or magnesium silicates.

Another possibility which may be envisaged for use as a carbon source is to employ tantalum carbide or other carbides. If a rod of tantalum not carrying current is brought to a temperature corresponding to the illuminant, for instance, then precisely the suitable equilibrium vapor pressure of carbon, at which evaporation or deposition of carbon no longer takes place on the illuminant, is set up over the tantalum carbide. This may for example be done by introducing a rod/wire of tantalum carbide inside on the axis of a filament made of tantalum carbide (similarly as a filament with internal feedback as employed for IRC lamps, although current does not flow through the wire on the filament axis in the metal carbide lamps), in which case the turns of the current-carrying filament consisting of TaC wire must not touch the rod of TaC not carrying current in order to avoid a short circuit. The rod must be at virtually the same temperature as the neighboring turns. It must in no case be significantly cooler than the neighboring turns, i.e. the thermal dissipation along the rod must be limited—for example by selecting a sufficiently small diameter. An equilibrium vapor pressure of carbon is set up over the rod. The carbon is transported past the current-carrying TaC filaments to the bulb wall by the concentration gradient directed radially outward. The individual turns of the TaC filaments therefore lie in a constant stream of carbon, with the carbon partial pressure corresponding to the equilibrium pressure over the filaments. The carbon transported outward reacts again close to the bulb wall with hydrogen to form hydrocarbons, which are then decomposed on a suitable catalyst as described above while depositing carbon and releasing hydrogen. Overall, therefore, carbon is transported from the TaC rod lying on the axis of the filament, past the TaC filament to the carbon sink, with the carbon partial pressure corresponding approximately to the equilibrium carbon pressure at the individual turns and the turns consisting of TaC therefore being stabilized. In other words, the carbon evaporated from the individual turns of the TaC filament and transported outward is replaced from the inside by the carbon evaporating from the TaC rod. The advantage of using a rod of TaC over using a rod for example of pure carbon is that, at the same temperature, the carbon vapor pressure over pure carbon is orders of magnitude higher than that over tantalum carbide, so that unnecessarily strong carbon transport would be generated in this case and sometimes carbon would even be deposited on the TaC filament. The advantage of using a TaC rod on the filament axis, the rod's temperature profile corresponding as accurately as possible to that of the filament, is that the equilibrium carbon pressures that prevent destruction of the illuminant are then set up automatically at the individual turns of the TaC filament.

Besides carbon itself and carbon-hydrogen compounds, compounds of carbon with other elements may also be envisaged as a source for carbon.

For example, it is advantageously possible to employ polymers containing carbon and fluorine as obtained, for example, by the polymerization of tetrafluoroethylene $C_2F_2$ (for example polytetrafluoroethylene PTFE, brand name "Teflon" from DUPONT). The decomposition of these compounds forms compounds such as $CF_4$, $C_2F_4$ etc. in the gas phase, which decompose only at extremely high temperatures close to the illuminant while releasing carbon and fluorine. An advantage in this case is that the carbon is released especially or almost exclusively on positions at high temperature. The carbon is therefore transported expediently to positions at a high illuminant temperature. Owing to the controlled flow back to positions at high temperature, it is possible here to operate with relatively small fluxes of carbon or relatively low partial pressures of gaseous C—F compounds. The released fluorine reacts on the wall to form gaseous $SiF_4$, although this then scarcely affects the reaction phenomenon and also does not—as for example hydrogen does—detrimentally affect the efficiency of the lamp owing to increased thermal conduction. The carbon thereby released—as long as it is not used up by CO formation in the wall reaction—may then again firstly be bound in cooler regions by means of a transport partner such as chlorine and then re-decomposed on a hot metal wire, the carbon being deposited again and the chlorine being released (carbon sink). Since two F atoms release one O atom in the wall reaction and approximately one C atom occurs per two F atoms in polytetrafluoroethylene, the carbon is substantially converted into CO by the oxygen released in the wall reaction.

The present invention is suitable in particular for low-tension lamps with a voltage of at most 50 V, because the illuminants needed therefor can be made relatively sizeable and the wires for this preferably have a diameter of between 50 μm and 300 μm, in particular at most 150 μm for general lighting purposes with a maximum power of 100 W. Thick wires of up to 300 μm are used in particular for photo-optical applications up to a power of 1000 W. The invention is particularly preferably used for single-pinch lamps, since in this case the illuminant can be kept relatively short so that the susceptibility to breakage is likewise reduced. Nevertheless, application is also possible for double-pinch lamps and lamps for mains voltage operation. The term rod as used here in refers to a means which is designed as a solid rod, or in particular as a thin wire.

The described concept may be applied miscellaneously to special chemical transport systems. In a special embodiment, it is used for a carbon-sulfur cycle process configuration. As described in DE No. 10358262.2, CS decomposes first at temperatures significantly above 3000 K, the dissociation factor of CS increasing greatly with a rising temperature. The C—S cycle process is therefore suitable for transporting the carbon back to the hottest deposition along the filament and therefore retarding or preventing the formation of "hot-spots". When using this C—S system, it is then necessary to take into account the fact that the compound CS transporting the carbon into the high-temperature region disproportionates at temperatures below about 2200 K according to $2CS \rightarrow CS_2 + C$, carbon being deposited on the framework or the filament connections. If on the other hand $CS_2$ is transported back by diffusion or flow to positions at high temperature, then it decomposes at T>2200 K into CS and sulfur, the sulfur having a decarburizing effect on the metal carbide illuminant. It is therefore advantageous to coat the illuminant or its connections with a carbon layer in the region above 2200 K. The sulfur atoms released in this temperature range then react with the carbon to form CS; decarburizing of the metal carbide illuminant is avoided. In the course of the lifetime, this carbon coating becomes slowly used up. At lower temperatures below about 2200 K, on the other hand, carbon is released and deposited by the disproportionation of CS. In summary, the C—S system therefore transports the carbon from positions at high temperature with T>2200 K to positions at lower temperature with T<2200 K. Without the reservoir of carbon for T>2200 K (source) or the deposition of carbon at T<2200 K (sink), steady-state operating conditions can be achieved only with difficulty.

The methodology described here can also be applied to incandescent filaments made of materials other than metal carbides, borides or nitrides. An application to pure metals such as tungsten will be described by way of example below. In order to create a regenerative cycle process that extends the lifetime, in which "hot-spots" on the illuminant are remedied, the fluorine cycle process is described in the literature, cf. for example (a) J. Schröder, Kino-Technik No. 2, 1965, (b) Dittmer, Klopfer, Rees, Schröder, J.C.S Chem. Comm., 1973. The regenerative action of the fluorine cycle process is based on tungsten fluorides first decomposing at temperatures above approximately 2500 K, the tungsten preferentially being re-deposited at the hottest positions. An essential difficulty with using fluorine is that fluorine reacts to form silicon tetrafluoride $SiF_4$ on the bulb wall, oxygen furthermore being released as well. The fluorine bound in $SiF_4$ is no longer available for further reaction in the halogen cycle process. Several ways of passivating the bulb wall are therefore reported in the literature, cf. for example Schröder, PHILIPS Techn. Rundschau 1963/1964, p. 359 regarding the use of $Al_2O_3$. Another possibility is provided by using the concept discussed here. To this end, high molecular weight compounds of carbon and fluorine, for example polytetrafluoroethylene, are used as a fluorine source. These compounds decompose slowly at high temperatures, low molecular weight species containing carbon and fluorine being formed in the gas phase. The released fluorine reacts on tungsten surfaces in the temperature range between approximately 1600 K and 2400 K to form tungsten fluorides. Framework parts or filament connections made of tungsten, which are at corresponding temperatures, are therefore preferably configured to be thicker in order to make enough tungsten available for the cycle process. The tungsten fluorides formed in this way are transported to positions at high temperature, where they decompose preferentially on positions at high temperature. Tungsten is therefore transported back expediently to the hottest positions of the illuminant. When fluorine or fluorine compounds reach the glass wall of the bulb, fluorine reacts to form $SiF_4$ and is therefore not available for further participation in chemical transport reactions. Oxygen is furthermore released by the wall reaction. Since one carbon atom occurs per two fluorine atoms in polytetrafluoroethylene and two fluorine atoms respectively release one oxygen atom in the wall reaction, in stoichiometric terms the oxygen released in the wall reaction can be gettered completely by the carbon to form CO. Since released carbon usually also becomes bound in other ways, for example in the form of carbides, the gettering of oxygen by carbon does not normally take place completely. If need be, therefore, other getters such as phosphorus must therefore also be used. The tungsten fluorides formed at the tungsten reservoir are not completely transported in the direction of the illuminant by the convection or diffusion, or are not fully converted there; some is transported in the direction of the bulb wall. There, the tungsten fluorides decompose at least partially while releasing fluorine, which reacts in the described way with the wall, and tungsten. In order to avoid blackening of the lamp bulb, the simultaneous use of bromine is recommended. In this way, tungsten (oxy) bromides can be formed and the bulb wall is kept clean. Tungsten oxybromides decompose at temperatures far lower than that of the illuminant. This means that the tungsten bound in them becomes deposited primarily on the framework or the filament connections. This superimposed W—Br—(O) cycle process is therefore not regenerative, and it serves merely to keep the lamp bulb clear.

The basic principle described here—the continuous transport of a substance from a source into a sink—can also be applied to the transport medium which is used for keeping the bulb clear as well as returning material to the illuminant. Here, the situation may arise that either the transport means is removed constantly from the gas phase by reaction or absorption with parts of the framework or the bulb wall (sink), or it is introduced constantly into the gas phase by desorption or chemical reaction (source). In order to achieve steady-state conditions in the gas phase, in such a case it is therefore recommendable to additionally introduce a source into the lamp in the event of a sink, and to additionally introduce a sink in the event of a source.

The continuous transport of hydrogen from a source into a sink will be discussed as a first example. The hydrogen incorporated in the illuminant (metal carbide), hydrogen held in the leads or getters (possibly bound as a metal hydride, for example tantalum hydride) may be used as a source for hydrogen. During the carburization, the rod lamp can be expediently enriched with hydrogen via the hydrogen partial pressure and the temperature distribution in the illuminant and the leads. In lamp operation, different temperature distributions prevail than during the carburization. At about 3300 K-3600 K, the illuminant temperature in lamp operation is higher than during the carburization (2800 K-3100 K); furthermore, higher hydrogen partial pressures can be set up during the carburization. Therefore, framework parts made for example of tantalum or niobium lying at a suitable temperature can absorb hydrogen during the carburization. Subsequently in lamp operation, these high-temperature framework parts lie in an atmosphere which contains less hydrogen, and they therefore release hydrogen (source). Framework parts lying at a significantly lower temperature absorb this hydrogen (sink). For example in the case of lamps having a TaC illuminant with integral filament connections (similarly as in FIG. 1), the filament connections are not carburized during the carburization; tantalum is therefore available in a large temperature spectrum here, so that in any event positions that can act as a source or sink arise. Furthermore, quartz glass can also act as a hydrogen source, which can be achieved by setting up a suitable content of OH groups in the glass (by the vacuum annealing of quartz glasses). The filling gas subsequently introduced must take these material rearrangements into account. If necessary, other compounds or metals which can act as a hydrogen store, for example zirconium, may be used as hydrogen sources. These components will be fastened on the framework or filament connections so that hydrogen is slowly given off over relatively long times at the temperatures set up.

The second example relates to the use of sulfur in a lamp having a metal carbide illuminant and an integral layout of the filament and filament connections, i.e. the filament and filament connections are made integrally from a tantalum wire and then the illuminant is carburized. The filament connections are not completely co-carburized during the carburization, i.e. tantalum or tantalum subcarbide $Ta_2C$ is also found here. In this range of low temperatures, sulfur inside the lamp is converted into the very stable compound tantalum sulfide and the sulfur is therefore removed from the gas phase (sink). The sulfur removed from the gas phase must be constantly replenished (source), in order to sustain a C—S cycle process. This may for example be done by evaporating $CH_3CSCH_3$ permanently from a reservoir (for example consisting of rubber) impregnated therewith. In the case of lamps with extremely low bulb temperatures below about 100° C., elementary sulfur, which has a considerable vapor pressure even at lower temperatures and melts somewhat above 100° C., may be used as a source. It is also possible to use high-melting, high molecular weight mercaptans as a sulfur source.

BRIEF DESCRIPTION OF THE DRAWINGS

The invention will be explained in more detail below with the aid of several exemplary embodiments

PREFERRED EMBODIMENT OF THE INVENTION

Figure 1:
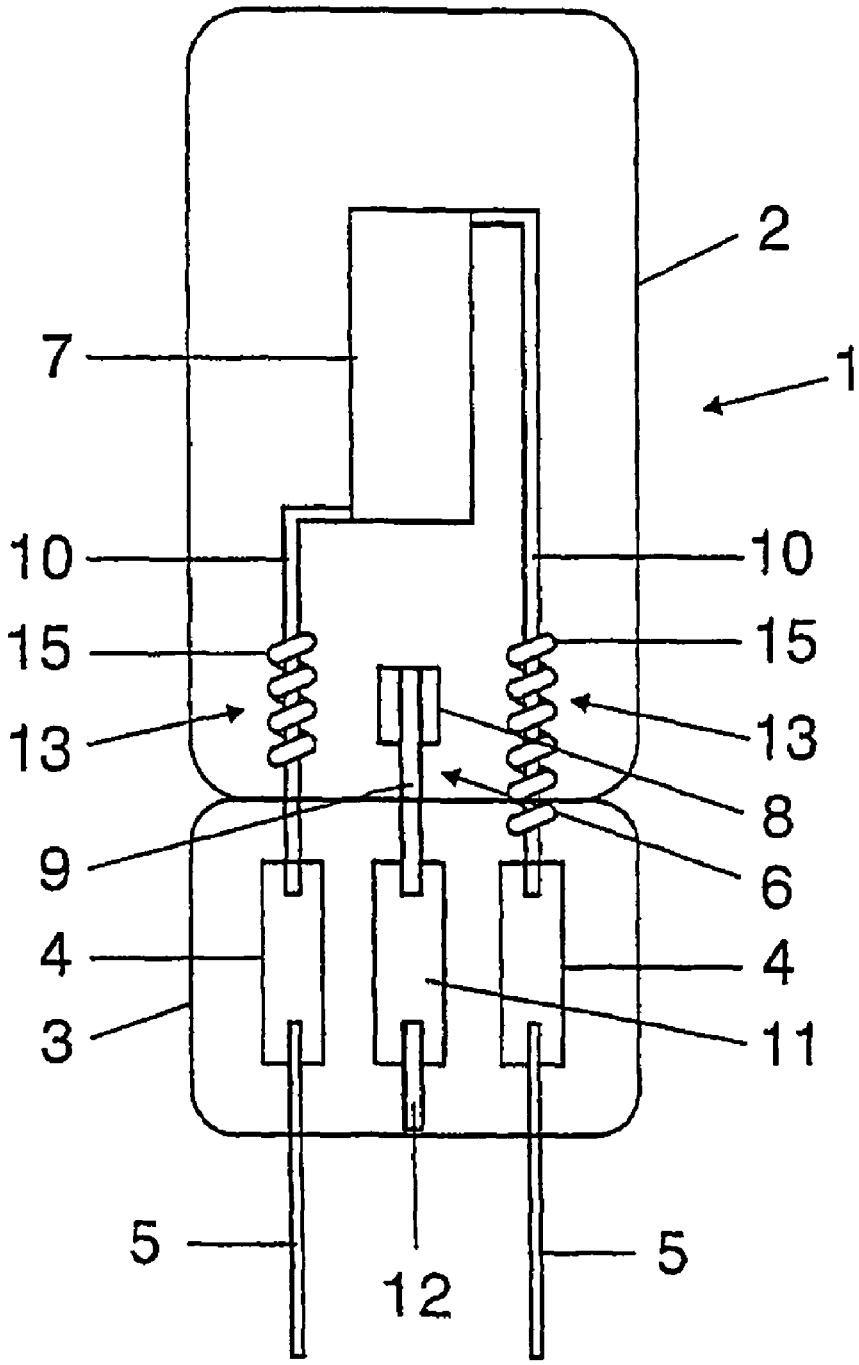
FIG. 1 shows an incandescent lamp having a carbide illuminant according to one exemplary embodiment.

FIG. 1 shows a single-pinch incandescent lamp 1 having a bulb made of quartz glass 2, a pinch seal 3 and inner electrodes 10, which connect foils 4 in the pinch seal to an illuminant 7. The illuminant 7 is a singly wound, axially arranged wire made of TaC, whose ends 14 are unwound and stand transversely to the lamp axis. The outer leads 5 are attached externally to the foils 4.

The design described here may for example also be adapted to lamps having illuminants made of other metal carbides, for example hafnium carbide, zirconium carbide, niobium carbide. It is also possible to use alloys of different carbides. The use of borides or nitrides, in particular rhenium nitride or osmium boride, is furthermore possible.

In general, the lamp preferably uses an illuminant made of tantalum carbide, which preferably consists of a singly wound wire. Zirconium carbide, hafnium carbide, or an alloy of different carbides as described for example in U.S. Pat. No. 3,405,328, is also preferably suitable as a wound wire.

The bulb is typically made of quartz glass or hard glass with a bulb diameter of between 5 mm and 35 mm, preferably between 8 mm and 15 mm.

The filling is primarily inert gas, for example noble gas such as Ar, Kr or Xe, optionally with the admixture of small amounts (up to 15 mol %) of nitrogen. A hydrocarbon, hydrogen and a halogen additive are typically added to this.

A halogen additive is expedient irrespective of possible carbon-hydrogen cycle processes or transport processes, in order to prevent the metal evaporated from the illuminant made of metal carbide from depositing on the bulb wall and to transport it back as much as possible to the illuminant. This involves a metal-halogen cycle process as described for example in the application DE-No. 103 56 651.1. In particular, the following fact is important: the more the evaporation of carbon from the illuminant can be suppressed, the less is the evaporation of the metallic components as well, see for example J. A. Coffmann, G. M. Kibler, T. R. Riethof, A. A. Watts: WADD-TR-60-646 Part I (1960).

Specific embodiments, which explain the essence of the invention in more detail, will be presented below.

(a) Exemplary Embodiments of Lamps Having an Illuminant Made of TaC and with a Solid Hydrocarbon as the Source Among the aliphatic hydrocarbons, only high molecular weight compounds are generally viable owing to the otherwise too low melting point (for example, the melting point of $C_{56}H_{114}$ is only just below 100° C., which is too low for most applications; this is unless it is possible to use liquid compounds). Aromatic hydrocarbons are more suitable, for example anthracene (melting point 216° C.), naphathcene (melting point 355° C.), coronene (melting point 440° C.), which also have the advantage that much less hydrogen is introduced into the lamp per C atom. For example, the vapor pressure of anthracene just below the melting point is around 50 mbar, and somewhat above 1 mbar at 145° C. By locating the source in a region at a suitable temperature, it is possible to set up a suitable vapor pressure. The vapor pressure of the hydrocarbon must for instance be adjusted so that the molar concentration of C atoms, set up after its full decomposition at the TaC illuminant, is of the order of the equilibrium concentration of C atoms over the illuminant; the precise value depends on details (distance from the C source to the illuminant and to the sink, decomposition rate of the hydrocarbons at the sink, etc.). When using anthracene as a source for carbon, the suitable temperature for the source lies in the range between 120° C. and 150° C. if the distance between the illuminant, for example at 3400 K, and the source is approximately 3 cm and, after decomposition of the hydrocarbons, the carbon is deposited on a hot nickel wire at approximately 400° C.-800° C. The cold filling pressure of such a lamp lies in the region of 1 bar; the inert gas (for example argon, krypton) preferably contains 2 mbar—20 mbar of hydrogen $H_2$, 0.5 mbar of $CH_2Br_2$ and 2 mbar—20 mbar of iodine. The bromine is intended to prevent tantalum from depositing on the bulb (see DE-No. 103 56 651.1) and the iodine is intended to bind the hydrogen released in the course of the evaporation and decomposition of the anthracene in the form of HI. Here, HI constitutes a sink for the released hydrogen.

FIG. 1 schematically represents an example of a possible design of the source and sink for a single-pinch lamp. The source 6 uses a solid hydrocarbon 8 as the source material, which has been deposited on the end of a wire-shaped rod 9, often referred to as a medium holder, made of tungsten. The rod 9 is supported by connecting it to an additional foil 11 in the middle of the pinch seal 3. To facilitate introduction, this may comprise an outer wire attachment 12 which typically consists of molybdenum.

The sink 13 is formed by overcoat windings 15 on one or both electrodes 10. These windings consist for example of nickel wire. This may be applied in the internal volume, specifically in the vicinity of the pinch seal, or may even extend into the pinch seal as shown on the right-hand winding 15.

In this exemplary embodiment, both the source and the sink must be operated at relatively low temperatures, normally below about 500° C., as are found near the bulb wall. In respect of introduction, it is simplest to use the electrodes 10 near the pinch seal 3. As an alternative, the source could also be fastened on one electrode 10 and the sink on the other electrode 10.

The end of the medium holder 9 is coated here with the hydrocarbon used as the source material. Although this embodiment is simple to produce, it is necessary to accept the fact that the transport from the source into the sink primarily takes place past the illuminant 7. Yet since a particular time is needed for decomposition of the hydrocarbon on the catalyst, which is formed here by the sink made of nickel wire, an increased concentration of hydrocarbon or carbon is set up in the steady state throughout the gas phase, even outside the direct path from the source to the sink.

Figure 2:
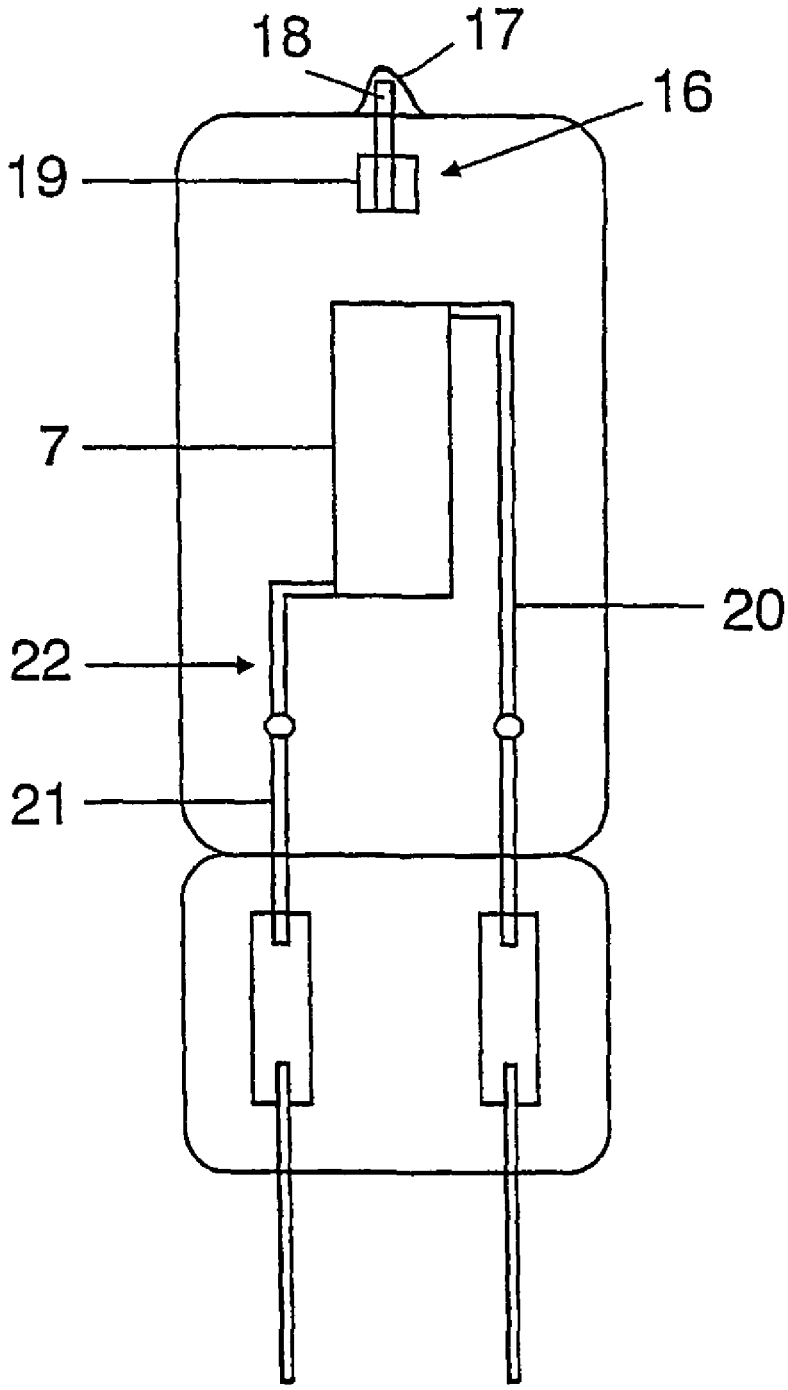
FIG. 2 shows an incandescent lamp having a carbide illuminant according to a second exemplary embodiment.

For the functionality, it is therefore advantageous to use an arrangement as in FIG. 2, the source 16 consisting of a holder 18 made of tungsten pinch-sealed in the pump gland 17, on whose end facing the illuminant 7 the source material 19 lies, i.e. a hydrocarbon which has been deposited as a solid.

The sink is formed here by the lower part 21, near the pinch seal, of the electrodes 22. This part 21 consists of molybdenum, which serves as a catalyst for decomposition of the hydrocarbons. The upper part 20 of the electrode is formed integrally by the carbide of the illuminant. The lower part 21 extends into the pinch seal.

With this geometrical arrangement, the illuminant 7 lies in the material stream which is formed from the source 16 to the sink 21. In FIG. 2, the lower part of the inner electrode 22 consists of molybdenum, which acts as a catalyst for decomposition of the hydrocarbons and therefore as a sink.

Figure 3:
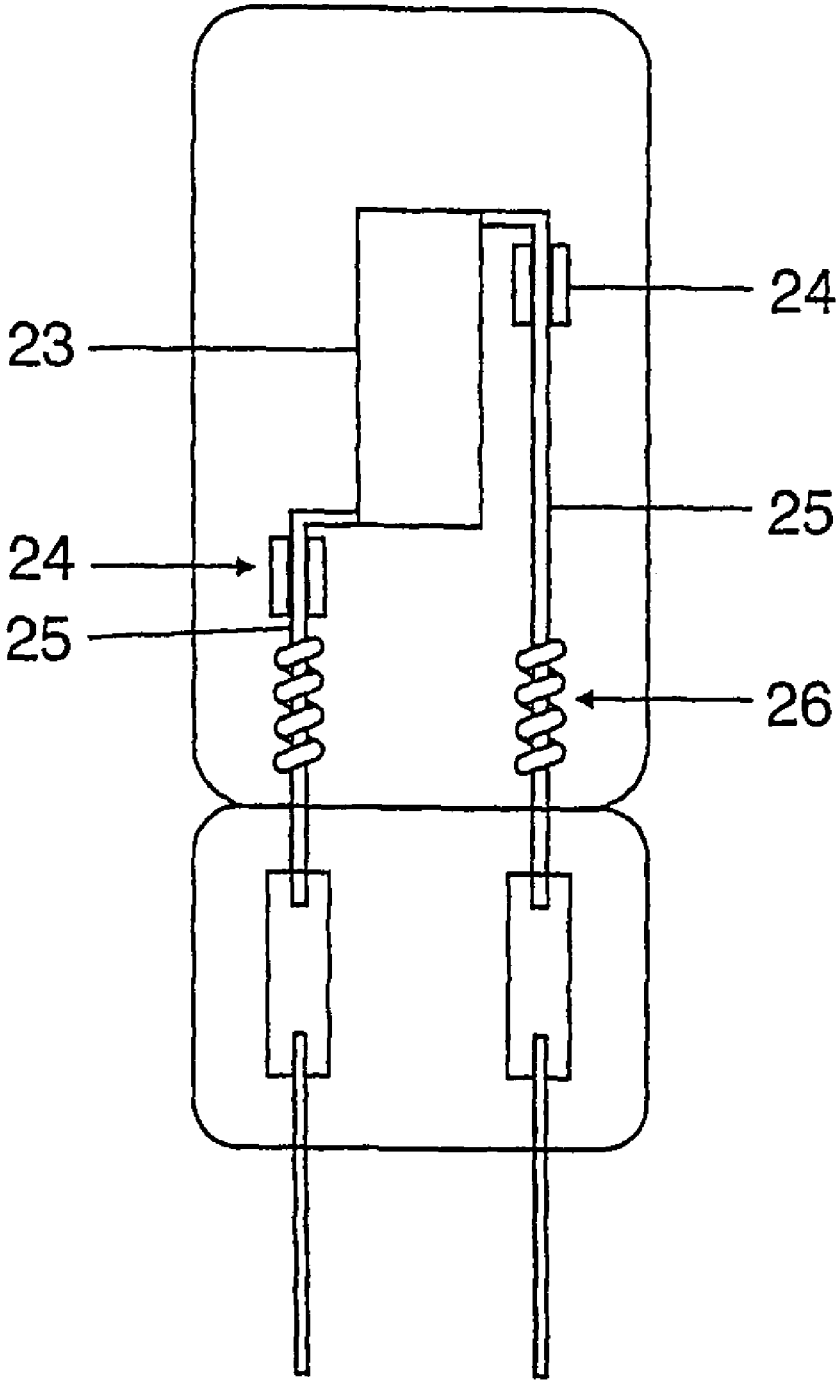
FIGS. 3 to 5 show an incandescent lamp having a carbide illuminant according to further exemplary embodiments.

(b) Exemplary Embodiments of Lamps Having an Illuminant Made of TaC and having a Carbon Source The illuminant 23 consisting of TaC, see FIG. 3, is operated at a temperature of between 3300 K and 3600 K. In order to generate a suitable carbon partial pressure at the site of the TaC illuminant, the carbon source 24 is kept in the temperature range between 2700 K and 3000 K. In order to avoid deposition of the carbon on the bulb wall and to transport the carbon to the sink, hydrogen is added to the inert gas (krypton, argon) and specifically so that the partial pressure of the hydrogen preferably lies in the range of between 2 mbar $H_2$ to 20 mbar $H_2$. No hydrogen is released from the source in this case, so that no sink for hydrogen is needed. The carbon source is at so high a temperature that no direct reaction with the hydrogen takes place. Suitable sinks for decomposing the hydrocarbons are, for example, wires or platelets made of nickel or iron or molybdenum, again operated at 400° C.-800° C., or aluminosilicate operated at temperatures around 500° C.

FIG. 3 shows a possible geometry for such a lamp. C deposits in the "upper" region of the electrodes 25, near the junction region with the filament 23 where there are already comparatively high temperatures, function as a carbon source 24. Depending on the embodiment of the filament in respect of the filament temperature profile, a carbon deposit on the outer turns of the illuminant may also be expedient. The electrode is in this case an integral connection of the filament 23. Instead of the C deposits, C fibers may also be wound around the connection. The sink 26 is in this case an overcoat winding of iron, which is coated with platinum. It is fitted near the pinch seal, i.e. at significant temperatures.

(c) Example of a Geometry Having a Source Arranged on the Filament Axis

Figure 4:
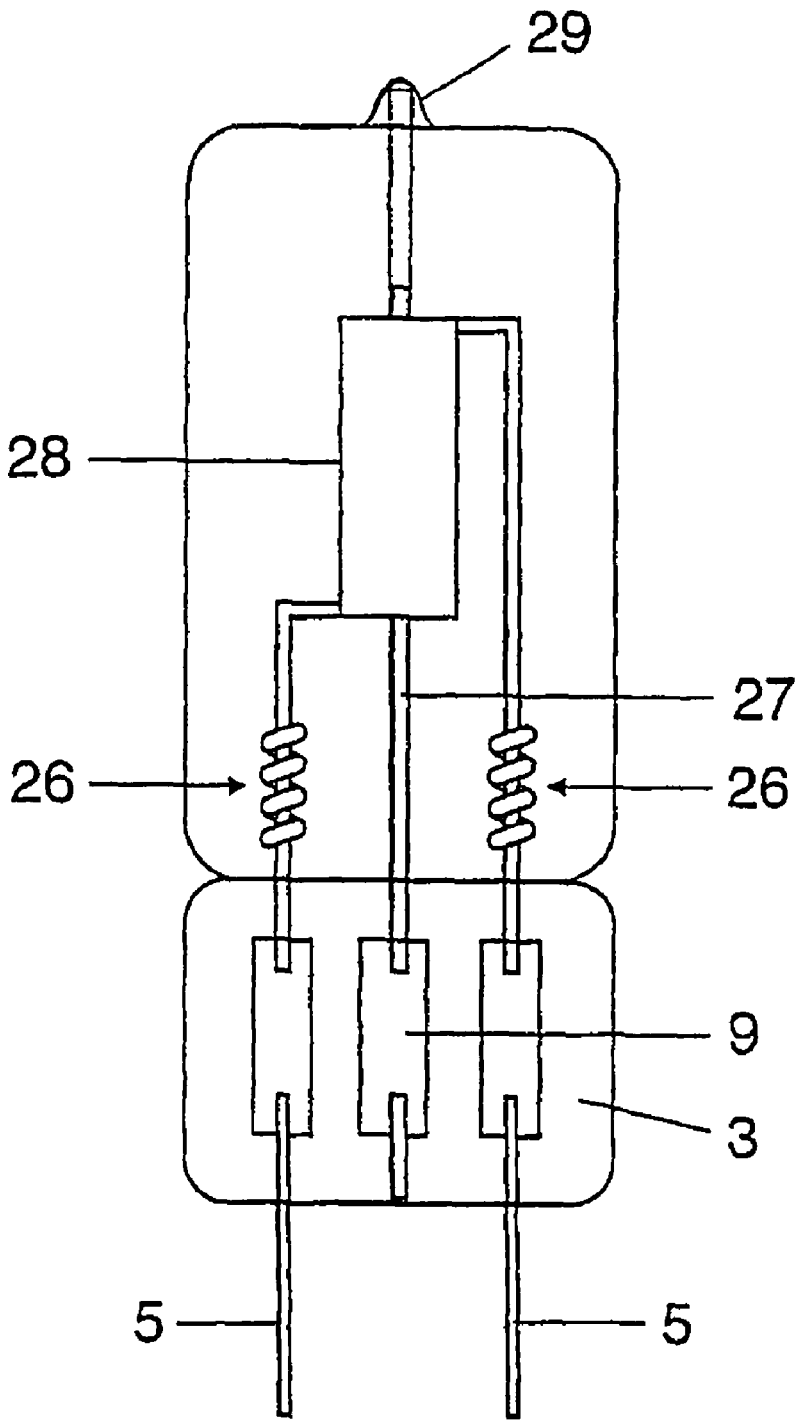

An example of a source which is arranged on the axis of the illuminant is shown in FIG. 4. Here, a rod 27 consisting of TaC lies in the lamp axis, which is also the axis of the illuminant. In the region of the filament 28, the rod 27 has approximately the same temperature profile as the filament itself. The filament is wound so widely that the rod 27 fits contactlessly into its axis. The sink is again formed by overcoat windings 26, as in FIG. 3. They consist of molybdenum. The rod 27 is supported by a medium holder 9 similarly as in FIG. 1. It may in particular extend into a pump gland 29, see the embodiment in dashes. It will be retained better in this way.

(d) Example of Use in a Double-Pinch Lamp

Figure 5:
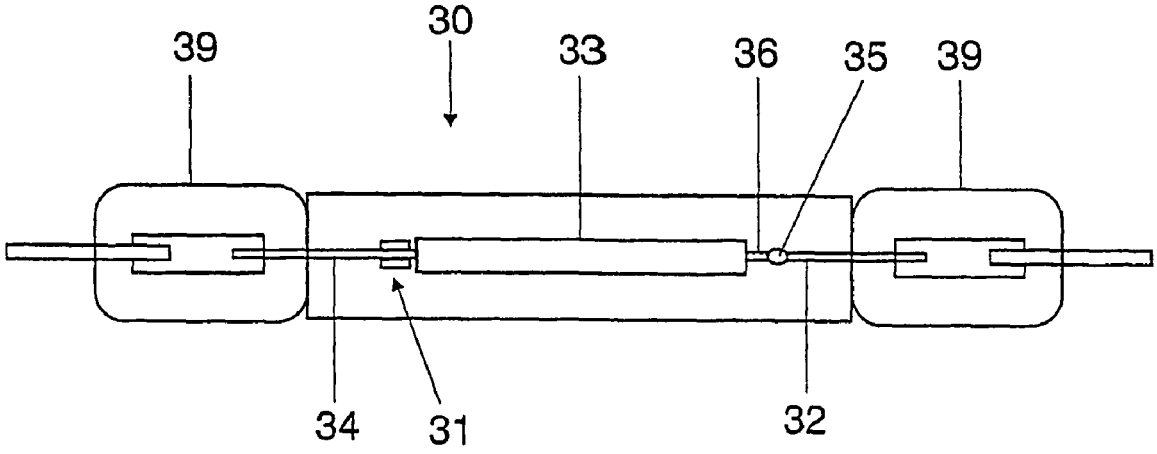

FIG. 5 shows a possible arrangement of a double-pinch lamp 30. Here, the source 31 and sink 32 may advantageously be arranged on different sides of the illuminant 33, so that the illuminant 33 lies in the transport stream from the source 31 to the sink 32 owing to the geometrical arrangement. The pinch seals are denoted by 39.

The source 31 is a carbon deposit (carbon black) or a carbon fiber wound around the electrode 34. The sink 32 is the part of an electrode which is made of molybdenum and is arranged facing away from the illuminant 33. This part is connected via a weld point 35 to the connection 36 of the illuminant made of TaC.

The entire temperature spectrum is advantageously available here on both sides of the illuminant 33 in the axial direction so that, for example, the C source can be arranged at relatively high temperatures in the vicinity of the illuminant and the sink can be arranged at relatively low temperatures further away from the illuminant on the other side. In the example shown in FIG. 5, the molybdenum connection acts as a sink.

A metal or a metal compound whose melting point lies close to the melting point of tungsten, preferably at least at 3000° C. and particularly preferably above that of tungsten, is suitable as the illuminant material. Besides tungsten, in particular rhenium, osmium and tantalum may be envisaged for this.

The invention claimed is:

1. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein the source consists of a graphite body, in particular graphite fibers, coated with the corresponding metal carbide, the carbon being transported to the sink by material additionally introduced as a constituent of the filling, from the group hydrogen and/or halogen, this material reacting in cooler regions with the carbon to form hydrocarbons or halogenated hydrocarbons, this hydrocarbon decomposing again at the sink while depositing carbon and releasing the transport medium.

2. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein the source consists of a sintered material containing carbon, the carbon being transported to the sink by material additionally introduced as a constituent of the filling, from the group hydrogen and/or halogen, this material reacting in cooler regions with the carbon to form hydrocarbons or halogenated hydrocarbons, this hydrocarbon decomposing again at the sink while depositing carbon and releasing the transport medium.

3. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein a rod fastened in the vicinity of the illuminant, in particular an axially arranged rod, made of the same metal carbide as the illuminant is used as the source for the carbon, the longitudinal temperature profile of which corresponds to that of the illuminant consisting of the same metal carbide, and hydrogen and optionally halogen are used as a medium for transporting the carbon to the sink.

4. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein a rod fastened in the vicinity of the axis of the illuminant, made of a second metal carbide is used as the source for the carbon, the vapor pressure of which at a given temperature is greater than that of the metal carbide of the illuminant wire, in order to compensate for the losses by thermal conduction along the wire fastened in the axis of the filament, and hydrogen and optionally halogen are used as a medium for transporting the carbon to the sink.

5. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in stead-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein the source consists of a solid or liquid hydrocarbon or halogenated hydrocarbon which is operated in the temperature range of between 100° C. and 400° C., and which releases carbon during decomposition, wherein the sink for the carbon consists of aluminum, magnesium or molybdenum silicates.

6. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein a fluorinated, in particular perfluorinated hydrocarbon, in particular PTFE, which delivers perfluorinated carbon compounds as decomposition products at high temperatures, it is used as the source.

7. The incandescent lamp as claimed in claim 6, wherein the carbon is transported by means of halogen, preferably chlorine to the sink which consists of a catalytically active metal or a carbide-forming metal, in particular nickel, iron, molybdenum, cobalt, platinum, tungsten or tantalum.

8. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the metal compound is a metal carbide, for example tantalum carbide, zirconium carbide or hafnium carbide or alloys of different metal carbides, and wherein the source consists of a body made of the same or another metal carbide, coated first with carbon in a first layer and then with metal carbide in a second layer, the carbon being transported to the sink by material additionally introduced as a constituent of the filling, from the group hydrogen and/or halogen, this material reacting in cooler regions with the carbon to form hydrocarbons or halogenated hydrocarbons, this hydrocarbon decomposing again at the sink while depositing carbon and releasing the transport medium.

9. The incandescent lamp as claimed in claim 8, wherein the outer second layer is an alloy of different metal carbides, in particular an alloy of tantalum carbide and hafnium carbide.

10. An incandescent lamp having an illuminant which contains a high-temperature resistant metal compound and having electrodes which hold the illuminant, the illuminant being introduced vacuum-tightly together with a filling in a bulb, the material of the illuminant comprising a metal or a metal compound, in particular a metal carbide, whose melting point lies close to the melting point of tungsten, at least at 3000° C., wherein the illuminant contains a material which becomes depleted of at least one chemical element owing to chemical decomposition and/or evaporation during operation, and in that a source and sink for this element are fitted in the bulb, the source delivering the element of which the illuminant is depleted and the element which the illuminant emits progressively during the lifetime being deposited on the sink, with the aid of a transport medium, so that overall there is a continuous flux of the described element from the source to the sink, the concentration of the relevant element being essentially steady at any position in the lamp, apart from startup processes, the illuminant in steady-state operation being in equilibrium with the partial atmosphere of the element constantly transported past it, imposed from the outside by the interaction of the source and sink, so that the illuminant is prevented from being depleted of the element in question, wherein the illuminant consists of a metal, and wherein the illuminant consists of tungsten and a high molecular weight carbon and fluorine compound slowly decomposes over the lifetime of the lamp, fluorine being released which reacts to form tungsten fluorides at a tungsten reservoir applied in the temperature range between 1600 K and 2400 K and therefore having the function of a source which transports tungsten back preferentially to the hottest position on the illuminant, and the fluorine from the tungsten fluorides not converted at the illuminant reacting on the bulb wall to form gaseous $SiF_4$, or the tungsten being accumulated by a superimposed boron cycle process at cooler positions of the framework and thus having the function of a sink for tungsten and fluorine.

* * * * *